US007234678B1

(12) United States Patent
Shindo et al.

(10) Patent No.: US 7,234,678 B1
(45) Date of Patent: Jun. 26, 2007

(54) PROTECTION SYSTEM FOR TURBO MACHINE AND POWER GENERATING EQUIPMENT

(75) Inventors: Osamu Shindo, Yokohama (JP); Kazuhito Shinoda, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 100 days.

(21) Appl. No.: 10/944,883

(22) Filed: Sep. 21, 2004

(30) Foreign Application Priority Data

Sep. 22, 2003 (JP) ..... P2003-330071
Apr. 22, 2004 (JP) ..... P2004-126394

(51) Int. Cl.
*F01D 31/122* (2006.01)

(52) U.S. Cl. ..... 251/63.6

(58) Field of Classification Search ..... 251/63.6
See application file for complete search history.

(56) References Cited

U.S. PATENT DOCUMENTS

| | | | | |
|---|---|---|---|---|
| 1,503,683 | A | 8/1924 | Darling | |
| 2,386,067 | A | 10/1945 | Schlenker | |
| 3,219,056 | A | 11/1965 | Dyson | |
| 3,687,017 | A * | 8/1972 | Lewis et al. | 92/165 R |
| 3,807,438 | A | 4/1974 | Posipsak | |
| 4,343,454 | A * | 8/1982 | Kure-Jensen et al. | 251/26 |
| 4,475,710 | A | 10/1984 | Leupers et al. | |
| 4,969,281 | A * | 11/1990 | Bosshart | 38/47 |
| 5,848,779 | A * | 12/1998 | Murbe et al. | 251/29 |
| 6,089,255 | A * | 7/2000 | Bonnefous et al. | 137/312 |
| 6,854,705 | B2 * | 2/2005 | Wieder | 251/63.6 |

FOREIGN PATENT DOCUMENTS

| | | |
|---|---|---|
| DE | 2025836 | 12/1971 |
| GB | 537613 | 6/1941 |
| GB | 1130788 | 10/1968 |
| JP | 60-90901 | 5/1985 |
| JP | 61-19905 | 1/1986 |
| JP | 61-114009 | 7/1986 |
| JP | 2-267303 | 11/1990 |
| JP | 3-267510 | 11/1991 |
| JP | 8-158808 | 6/1996 |
| JP | 2000-64811 | 2/2000 |
| JP | 2003-138908 | 5/2003 |

OTHER PUBLICATIONS

European Patent Office "Partial European Search Report" dated Apr. 18, 2006, issued in counterpart Application No. 04022528.6—2315.

* cited by examiner

*Primary Examiner*—J. Casimer Jacyna
(74) *Attorney, Agent, or Firm*—Finnegan, Henderson, Farabow, Garrett & Dunner, L.L.P.

(57) ABSTRACT

A limit switch 6 is placed on an end portion of the trip rod 4, which converts the mechanical deviation of the trip rod 4 into an electrical signal. The electrical signal from the limit switch 6 is transmitted to quick acting solenoid valves placed in a drive unit for a steam valve via a sequence circuit device, and then the steam valve is closed. Accordingly, an equipment structure can be simplified and reliability can be improved as compared to conventional arts.

8 Claims, 12 Drawing Sheets

PROTECTION SYSTEM FOR TURBO MACHINE AND POWER GENERATING EQUIPMENT

CROSS-REFERENCE TO THE INVENTION

This application is based upon and claims the benefit of priority from the prior Japanese Patent Application No. 2003-330071, filed on Sep. 22, 2003; and the prior Japanese Patent Application No. 2004-126394, filed on Apr. 22, 2004; the entire contents of which are incorporated herein by reference.

BACKGROUND OF THE INVENTION

1. Field of the Invention

The present invention relates to a protection system for a turbo machine which detects abnormality of a turbo machine such as a steam turbine in a power generating facility and stops the turbo machine, and to a power generating equipment.

2. Description of the Related Art

In a power generating equipment or the like using a turbo machine such as a steam turbine, various protection systems are provided for the purpose of detecting, besides an abnormal phenomenon and failure, phenomena such as an elongation difference of a steam turbine, large vibration, high temperature in a low pressure exhaust room, low oil pressure of a bearing, low discharge pressure of a main oil pump, boiler/generator failure, and so on to prevent an accident from occurring or to minimize the damage due to the accident. Among these, an abnormal increase in a turbine rotation speed is the most important item, so that a protection system which detects the abnormal increase in a turbine rotation speed and stops the turbine is provided.

In a conventional protection system for a turbo machine, a transmitting means using oil pressure signals is generally used as a signal transmitting means. FIG. 11 shows a configuration of such a protection system for a turbo machine, and in the drawing, the numeral 1 denotes an emergency governor, and the numeral 2 denotes an emergency trip device placed in combination with the emergency governor 1. The emergency governor 1 includes an eccentric ring (or a pop-up pin) integrally incorporated in a rotation shaft of a steam turbine. Further, the emergency trip device 2 includes a latch mechanism 5 constituted of a trip finger 3 and a trip rod 4.

When the rotation speed of the steam turbine rises to a set rotation speed or above, a centrifugal force also occurs on the eccentric ring (or the pop-up pin) of the emergency governor 1 integrally incorporated in the rotation shaft of the steam turbine, and the eccentric ring turns to a mechanical deviation and moves. When the mechanical deviation (mechanical signal) of the eccentric ring becomes equal to a certain value or larger, the eccentric ring comes in contact with the trip finger 3 of the emergency trip device 2 and removes the latch mechanism 5 constituted of the trip finger 3 and the trip rod 4. As a result, the trip rod 4 is pushed out toward the emergency governor 1 side, which is detected as a mechanical deviation (mechanical signal) of the trip rod 4. This movement of the trip rod 4 of the mechanical type trip device is detected by a mechanical trip valve 10 and converted into an oil pressure signal.

This oil pressure is transmitted to a hydraulic drive mechanism or the like which drives a not-shown main steam stop valve via a hydraulic system constituted of a lock out valve 11, a master trip valve 12 and so on to thereby close the main steam stop valve (for example, refer to Japanese Utility-Model Laid-open Application No. Sho 61-114009).

In the conventional protection system for the turbo machine as described above, the transmitting means using oil pressures is used as the signal transmitting means, and it is a highly reliable system. However, there have been problems such that the use of oil pressures complicates the equipment structure, the use of high oil pressures can cause oil leakage, and improvement in performance such as transmission speed is limited.

SUMMARY OF THE INVENTION

An object of the present invention is to provide a protection system for a turbo machine and a power generating equipment capable of simplifying an equipment structure and improving reliability as compared to conventional arts.

A protection system for a turbo machine according to the present invention, which detects an abnormality by an abnormality detecting unit having an emergency governor provided on a rotation shaft of the turbo machine and a latch mechanism constituted of a trip finger and a trip rod in such a manner that when the rotation shaft of the turbo machine rotates to exceed a predetermined speed and a centrifugal force of a predetermined value or larger is applied to the emergency governor, the emergency governor and the trip finger come in contact and the latch mechanism is disengaged to move the trip rod, and closes a steam valve placed on a steam inlet of the turbo machine to shut off flow-in of steam into the turbo machine, is characterized by including: a detecting device configured to mechanically detect movement of the trip rod to generate an electrical abnormality signal; and a solenoid valve which is placed integrally on a drive unit constituted of a piston and cylinder which open and close the steam valve and a hydraulic system which introduces/discharges operating oil to/from inside of the cylinder, and discharges the operating oil from inside of the cylinder, wherein, based on the electrical abnormality signal from the detecting device, the solenoid valve is electrically actuated to discharge the operating oil inside the cylinder to close the steam valve.

Another protection system for a turbo machine according to the present invention, which detects an abnormality of the turbo machine by an abnormality detecting unit and generates an electrical abnormality signal, and closes according to the electrical abnormality signal a steam valve placed on a steam inlet of the turbo machine to shut off flow-in of steam into the turbo machine, is characterized by including: a solenoid valve which is placed integrally on a drive unit constituted of a piston and cylinder which open and close the steam valve and a hydraulic system which introduces/discharges operating oil to/from inside of the cylinder, and operates based on the abnormality signal; and a cartridge valve which is interposed in an oil path which discharges the operating oil from one side of the piston in the cylinder, introduces the operating oil once to the other side of the piston in the cylinder, and thereafter discharges the operating oil, and opens in conjunction with operation of the solenoid valve.

A power generating equipment according to the present invention having a turbo machine which rotates by steam to generate power and a steam valve placed on a steam inlet of the turbo machine is characterized by including: a protection system for a turbo machine which detects an abnormality of the turbo machine by an abnormality detecting unit and generates an electrical abnormality signal, and closes according to the electrical abnormality signal the steam valve to shut off flow-in of steam into the turbo machine, wherein the protection system of the turbo machine includes: a solenoid valve which is placed integrally on a drive unit constituted of a piston and cylinder which open and close the steam valve and a hydraulic system which introduces/discharges operating oil to/from inside of the cylinder, and operates based on the abnormality signal; and a cartridge valve which is interposed in an oil path which discharges the operating oil from one side of the piston in the cylinder, introduces the operating oil once to the other side of the piston in the cylinder, and thereafter discharges the operating oil, and opens in conjunction with operation of the solenoid valve.

A drive unit for a steam valve according to the present invention, in which a valve rod of the steam valve and a piston inside a cylinder are coupled together via an oil cylinder spring housing internally having an operation rod and an operating spring, and in which at the time to open the valve, the operation rod accommodated in the oil cylinder spring housing is moved by the piston inside the oil cylinder to a valve opening position against a restoring force of the operating spring, and at the time to close the valve, the operation rod is returned to a valve closing position by the restoring force of the operating spring, is characterized by including a drain hole which is formed on a lower portion of the oil cylinder spring housing and discharges water staying inside.

Another drive unit for a steam valve according to the present invention, in which a valve rod of the steam valve and a piston inside a cylinder are coupled together via an oil cylinder spring housing internally having an operation rod and an operating spring, and in which at the time to open the valve, the operation rod accommodated in the oil cylinder spring housing is moved by the piston inside the oil cylinder to a valve opening position against a restoring force of the operating spring, and at the time to close the valve, the operation rod is returned to a valve closing position by the restoring force of the operating spring, is characterized by including a drain hole placed on a flange body which is attached on an end portion on the steam valve side of the oil cylinder spring housing and supports the operation rod by penetration.

DESCRIPTION OF THE EMBODIMENTS

Hereinafter, embodiments of the present invention will be described with reference to the drawings. First, the configuration of a power generating equipment in which a turbo machine is provided will be described with reference to FIG. 6. Here, the turbo machine represents a steam turbine. A protection system in the following embodiment is placed in this steam turbine, and the description of a system shown in FIG. 6 is omitted in the respective embodiments.

Figure 6:
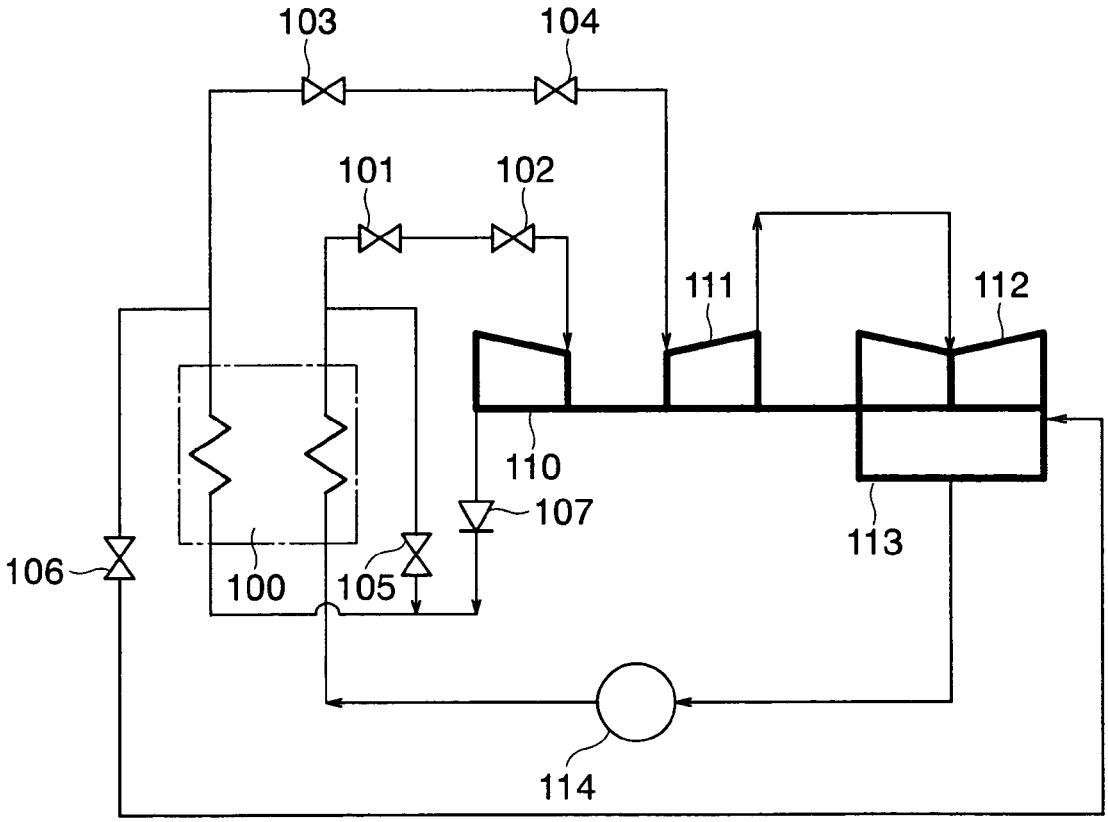
FIG. 6 is a diagram showing the configuration of a generating equipment in which a turbo machine is provided.

In FIG. 6, the numeral 100 denotes a boiler. Steam from this boiler 100 passes through a main steam stop valve 101 and a steam control valve 102 to work at a high pressure turbine 110. Thereafter, the steam passes through a check valve 107 and is heated again in a reheater of the boiler 100, and passes through a reheated steam stop valve 103 and an intercept valve 104 to flow into a medium pressure turbine 111 and a low pressure turbine 112 to work therein. The steam after working in the low pressure turbine 112 is circulated to be returned to water in a condenser 113, pressurized by a feed pump 114, and supplied again to the boiler 100.

Further, in order to enhance the operation efficiency of a plant, a high pressure turbine bypass valve 105 connected from a front of the main steam stop valve 101 to a front of the reheater of the boiler 100, a low pressure turbine bypass valve 106 connected from a rear of the reheater of the boiler 100 to the condenser 113, and the like are placed depending on the plant, and circulating operation of the boiler system alone can be carried out regardless of presence of turbine operation. Here, shown in FIG. 6 is a typical steam turbine power generating equipment, but as a matter of course, it can be operated as a combined cycle of single shaft type or multiple shaft type by combining gas turbines, which are not-shown in this power generating equipment.

Figure 1:
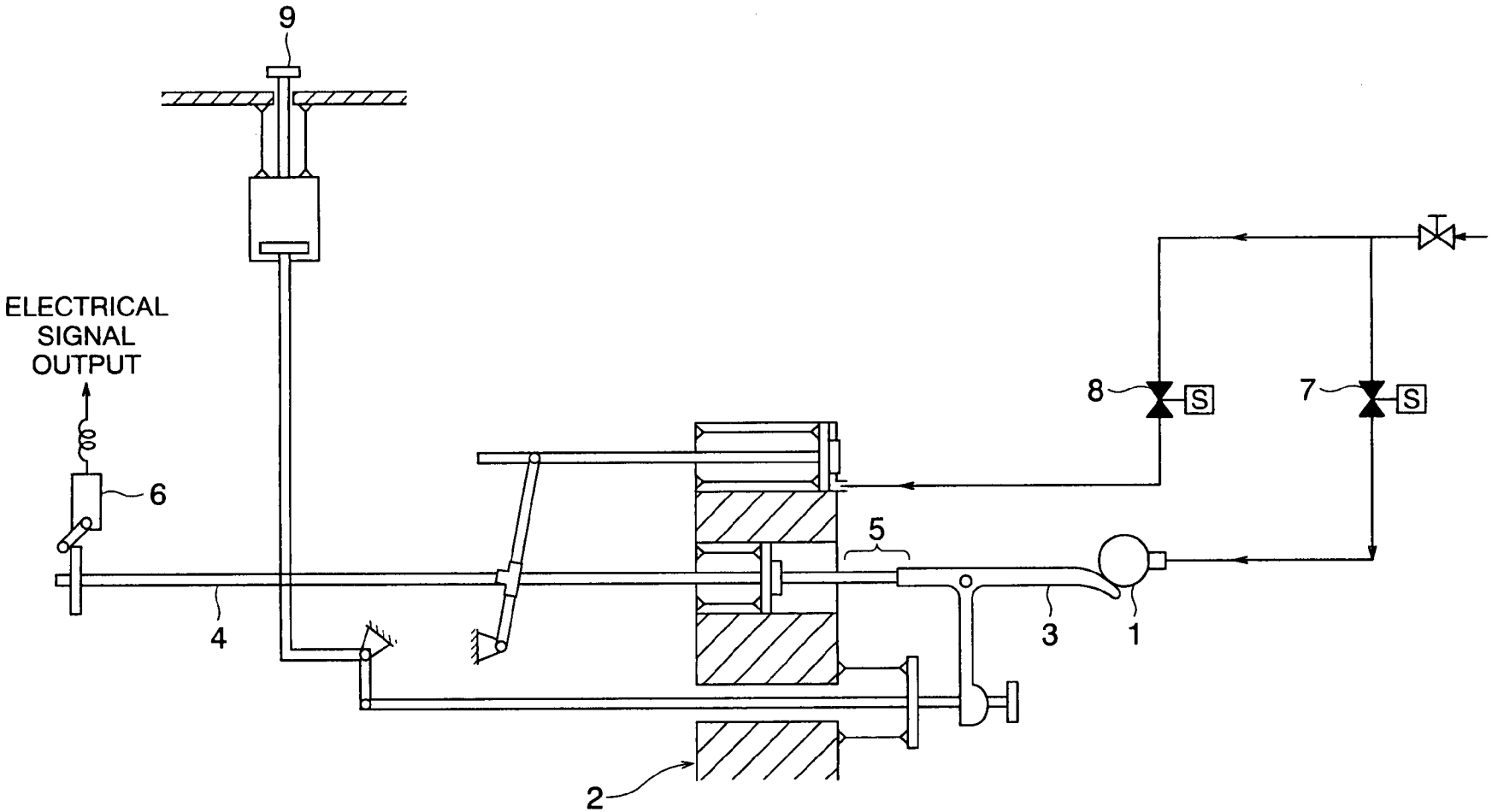
FIG. 1 is a view showing the configuration of an abnormality detecting unit according to an embodiment of the present invention.
Figure 2:
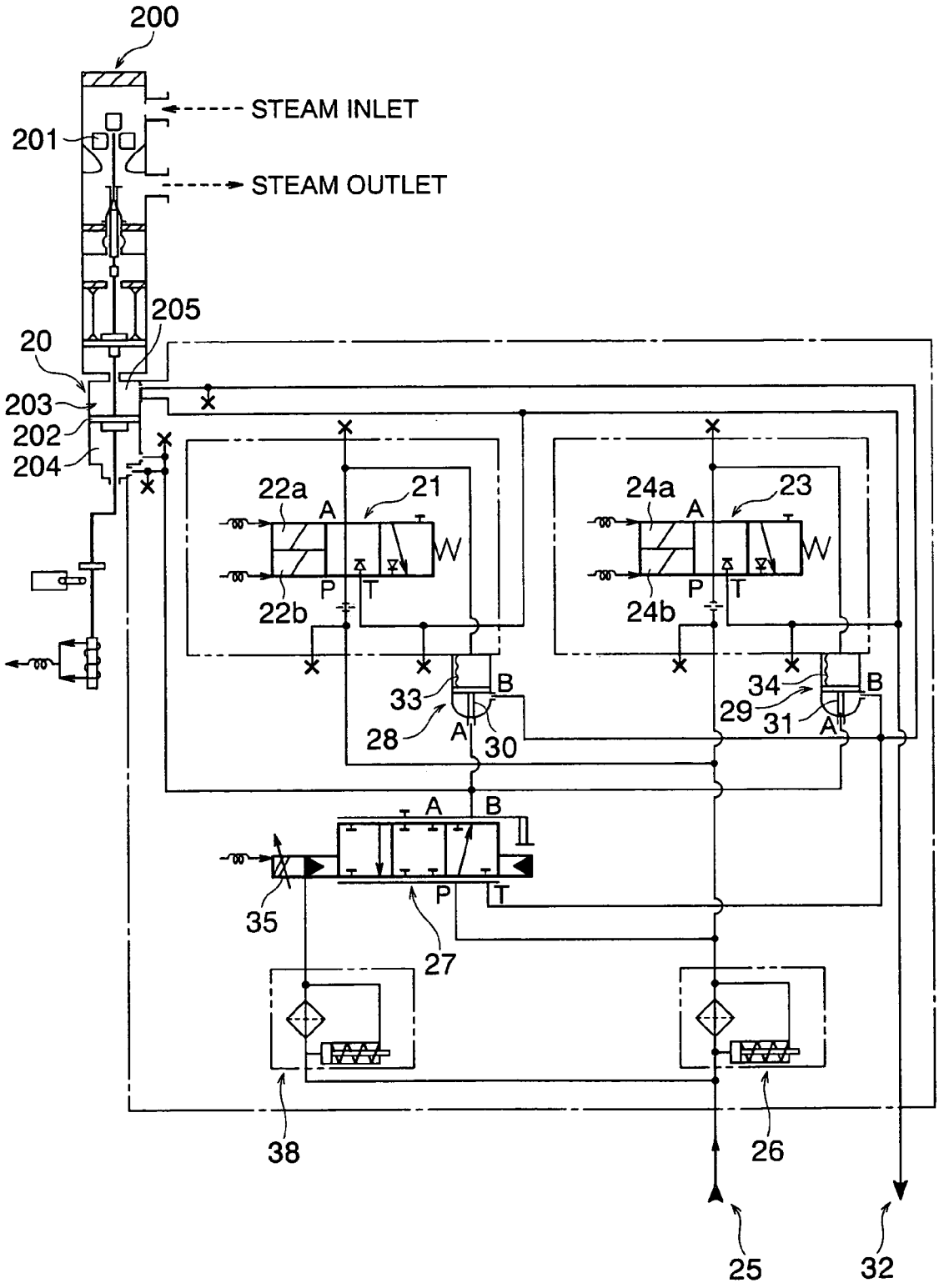
FIG. 2 is a view showing the configuration of a drive unit for a steam valve according to the embodiment of the present invention.

As described above, in steam turbines, it is demanded to detect various abnormal phenomena early to operate safely, and among these abnormal phenomena, an abnormal increase in steam turbine rotation speed is the most crucial item. FIG. 1 shows the configuration of an abnormality detecting unit for detecting such an abnormal increase in steam turbine rotation speed, and FIG. 2 shows the configuration of a drive unit for a steam valve which shuts off a flow of steam into a steam turbine.

In FIG. 1, the numeral 1 denotes an emergency governor, and the numeral 2 denotes an emergency trip device placed in combination with the emergency governor 1. The emergency governor 1 includes an eccentric ring (or a pop-up pin) integrally incorporated in a rotation shaft of a steam turbine. Further, the emergency trip device 2 includes a latch mechanism 5 constituted of a trip finger 3 and a trip rod 4. When the rotation speed of the steam turbine rises to a set rotation speed or above, a centrifugal force also occurs on the eccentric ring (or the pop-up pin) of the emergency governor 1 integrally incorporated in the rotation shaft of the steam turbine, and the eccentric ring turns to a mechanical deviation and moves. When the mechanical deviation (mechanical signal) of the eccentric ring becomes equal to a certain value or larger, the eccentric ring comes in contact with the trip finger 3 of the emergency trip device 2 and removes the latch mechanism 5 constituted of the trip finger 3 and the trip rod 4. As a result, the trip rod 4 is pushed out toward the emergency governor 1 side, which is detected as a mechanical deviation (mechanical signal) of the trip rod 4.

A limit switch 6 is placed on an end portion of the trip rod 4 that is pushed out, which converts the mechanical deviation (mechanical signal) of the trip rod 4 into an electrical signal. At least one limit switch 6 fulfills the purpose, but a plurality of the limit switches 6, three for example, may be placed for the purpose of improving reliability.

Incidentally, in the system in FIG. 1, there are placed an oil trip solenoid valve 7 for supplying oil in a manner that operation confirmation test can be performed while the emergency governor 1 is operating, and a reset solenoid valve 8 for returning the emergency trip device 2 to its original position after the test. Further, there is placed a trip handle 9 for an emergency stop of the turbine by human operation at the time of emergency. The trip handle 9 is constructed to remove the latch mechanism 5 of the trip finger 3 by pulling toward one's front side (upward in the drawing).

In the equipment having the above structure, an increase in the rotation speed of the steam turbine detected by the emergency governor 1 is mechanically detected without an intervention of a transmitting means using oil pressure signals, and is converted into an electrical signal.

An electric signal (contact signal) from the limit switch 6 is transmitted to a not-shown sequence circuit device, and an output electrical signal from the sequence circuit device is transmitted to quick acting solenoid valves 21, 23 placed in a drive unit 20 for a steam valve 200 shown in FIG. 2. The quick acting solenoid valves 21, 23 are important devices which shut off steam flowing into a steam turbine at the time of various abnormalities. Accordingly, electrical signals applied to the quick acting solenoid valves 21, 23 are applied in a constantly excited state while the steam turbine is operating normally, and meanwhile, applied in a non-excited state at the time of abnormality such as when the limit switch 6 operates and transmits an electrical signal from the sequence circuit device.

Also, as a method to obtain further reliability, the following methods exist. First, there is a method of placing a plurality, two each for example, of the quick acting solenoid valves 21, 23. In this case, as a method of supplying electrical signals outputted from the sequence circuit device to the quick acting solenoid valves 21, 23, there are a method of serially connecting electrical wires to the two quick acting solenoid valves 21, 23 and a method of connecting electrical wires in parallel so as to simultaneously apply the same signal to each of the quick acting solenoid valves 21, 23. In the case of the parallel wire connection, there are a method of setting a priority order for not operating a second one when a simultaneous application or an activation of a first one succeeds, a method of setting an order for alternately operating them, and a method of applying the signals with a slight time difference with each other (since it is not excited during the time of an actual abnormality, it means to release the electromagnetism with a slight time difference).

Further, there is a method of adopting a plurality of built-in coils 22, 24, two for example (coils 22*a*, 22*b* and coils 24*a*, 24*b*), in each of the quick acting solenoid valve 21, 23. When thus having two built-in coils, there are a method of serially connecting the two coils to make a serial connection and a method of connecting the coils in parallel so as to simultaneously apply the same signal to each coil. In the case of the parallel wire connection, there are a method of setting a priority order for not operating a second one when a simultaneous application or an activation of a first one succeeds, a method of setting an order for alternately operating them, and a method of applying the signals with a slight time difference with each other (since it is not excited during the time of an actual abnormality, it means to release the electromagnetism with a slight time difference).

Furthermore, regarding the wire connection of the coils 22, 24, since they are constantly excited during a normal operation, it is possible to achieve extended life spans of the coils 22, 24 by setting an applying voltage value (or current value) as 100% or by setting it as a voltage value (or current value) divided to each coil by 50% or the like for example. Regarding the structure of these coils 22, 24, other than the above-described structure, any one may be adopted as long as it is capable of achieving reliability and an extended life span.

Next, the configuration of the drive unit 20 portion of the steam valve 200 shown in FIG. 2 will be described. The steam valve 200 represents, for example, a main steam stop valve, and has a built-in sub valve for controlling a steam flow rate at the time of startup or the like, and has a mechanism capable of controlling a valve position using a servovalve. A steam pressure works on the upstream of a main valve 201, and inside a lower cylinder 204 of a drive piston 202 connected to the main valve 201, oil is accumulated so that an oil pressure works on a lower portion of the drive piston 202, thereby overcoming the steam pressure to open the main valve 201. On the other hand, at the time of abnormality of the steam turbine, by discharging the oil accumulated in the lower cylinder 204 of the drive piston 202, the main valve 201 operates to close.

Here, along with a large increase in capacity (output power) of steam turbines, the main valve diameter of these steam valves 200 becomes large, and there are tendencies to increase also the steam pressure. Accordingly, the oil pressure supplied to the drive unit 20 is preferred to be a high oil pressure for exhibiting basic performance such as a driving force for driving the steam valve 200 and a quick closing feature for the time when an abnormality occurs. Such an oil pressure is preferably 3 MPa or higher, and further, it is preferably a high oil pressure of 11 MPa, 17 MPa, 35 MPa or higher.

In FIG. 2, an operating oil 25 supplied from a not-shown oil pressure generating device flows in via an oil filter 26 at the entrance of the drive unit 20, and is branched into two at oil paths connected inside the drive unit 20.

One branched flow is supplied to a servovalve 27 serving as a steam flow rate controlling function for the steam valve 200, and the operating oil 25 passing through the servovalve 27 in accordance with a valve position control signal from a not shown turbine control device is supplied simultaneously to a lower portion of the drive piston 202 and to A ports (primary sides) of cartridge valves 28, 29. The drive piston 202 performs open/close operation by the operating oil 25 passing through the servo valve 27. The servovalve 27 is controlled by receiving a control signal at a coil 35 from the not-shown turbine control device, and a pilot oil for the servovalve 27 is branched from the upstream side of the oil filter 26 and supplied via a dedicated oil filter 38.

The other branched flow is branched again in two inside the drive unit 20, and thereafter connected to the quick acting solenoid valves 21, 23 placed on respective lines. Since the quick acting solenoid valves 21, 23 during normal operation are in the excited state, the operating oil 25 passes through the respective quick acting solenoid valves 21, 23 and is supplied to secondary sides of the cartridge valves 28, 29 respectively connected thereto. The operating oil 25 passing through the servovalve 27 and being supplied to the primary sides of the cartridge valves 28, 29 and the operating oil 25 passing through the quick acting solenoid valves 21, 23 and being supplied to the secondary sides of the cartridge valves 28, 29 work simultaneously on valve discs 30, 31 of the cartridge valves 28, 29. Accordingly, power is balanced therebetween, so that the valve discs 30, 31 of the cartridge valves 28, 28 do not move.

Here, when an abnormality is detected in the abnormality detecting unit shown in FIG. 1 and an electrical signal is generated from the limit switch 6, this signal is transmitted to the sequence circuit device. An output electrical signal from the sequence circuit device is transmitted to the quick acting solenoid valves 21, 23 placed in the drive unit 20 for the steam valve 200 shown in FIG. 2.

When the quick acting solenoid valves 21, 23 in the constantly excited state turn into the non-excited state, the operating oil 25 passing through the quick acting solenoid valves 21, 23 and being supplied to the secondary sides of the cartridge valves 28, 29 up to this time is drained 32 in conjunction with the quick acting solenoid valves 21, 23. Accordingly, the cartridge valves 28, 29 are pushed back by the hydraulic force of the operating oil 25 passing through the servovalve 27 and being supplied to the primary sides of the cartridge valves 28, 29, so that the A ports move to open. As a result, the operating oil accumulated in the lower cylinder 204 of the drive piston 202 on the same line as the A ports of the cartridge valves 28, 29 is discharged from B ports of the cartridge valves 28, 29, so that the steam valve 200 closes.

At this time, as shown in FIG. 2, since the B ports of the cartridge valves 28, 29 are connected to the upper cylinder 205 located at an upper portion of the drive piston 202 of the drive unit 20, the operating oil from the B ports of the cartridge valves 28, 29 flows into the upper cylinder 205 of the drive piston 202 inside the cylinder 203, passes through the upper cylinder 205 of the drive piston 202, and is drained 32. Thus, by once allowing the operating oil accumulated in the lower cylinder 204 of the drive piston 202 inside the cylinder 203 to flow into the upper cylinder 205 of the drive piston 202, an operation to push down the drive piston 202 is generated, which also operates as a drain tank, so that the steam valve 200 can be more quickly and surely closed.

On the secondary sides of the cartridge valves 28, 29, reset springs 33, 34 for the valve discs 30, 31 of the cartridge valves 28, 29 are incorporated. When the oil pressures on the A ports of the cartridge valves 28, 29 disappear, the valve discs 30, 31 of the cartridge valves 28, 29 are automatically returned by the forces of the reset springs 33, 34 to a fully closed state so as to cover the openings of the A ports.

Regarding such oil supplied to the drive piston 202 via the servovalve 27 while the quick acting solenoid valves 21, 23 are operating in the non-excited state, the servovalve 27 can be activated to shut off the supply of the operating oil 25 by a control signal from the not-shown turbine control device. Further, at the same time as operation of the quick acting solenoid valves 21, 23, the servovalve 27 can be operated so that the oil is discharge from the same line as the A ports of the cartridge valves 28, 29 via the servovalve 27 so as to facilitate quick closing operation of the steam valve 200, namely, oil discharge from the lower cylinder 204 of the drive piston 202.

Further, when the quick acting solenoid valves 21, 23 return again to the excited operation, oil can be supplied again via the servovalve 27 to the drive piston 202 by a control signal from the not-shown turbine control device.

Figure 3:
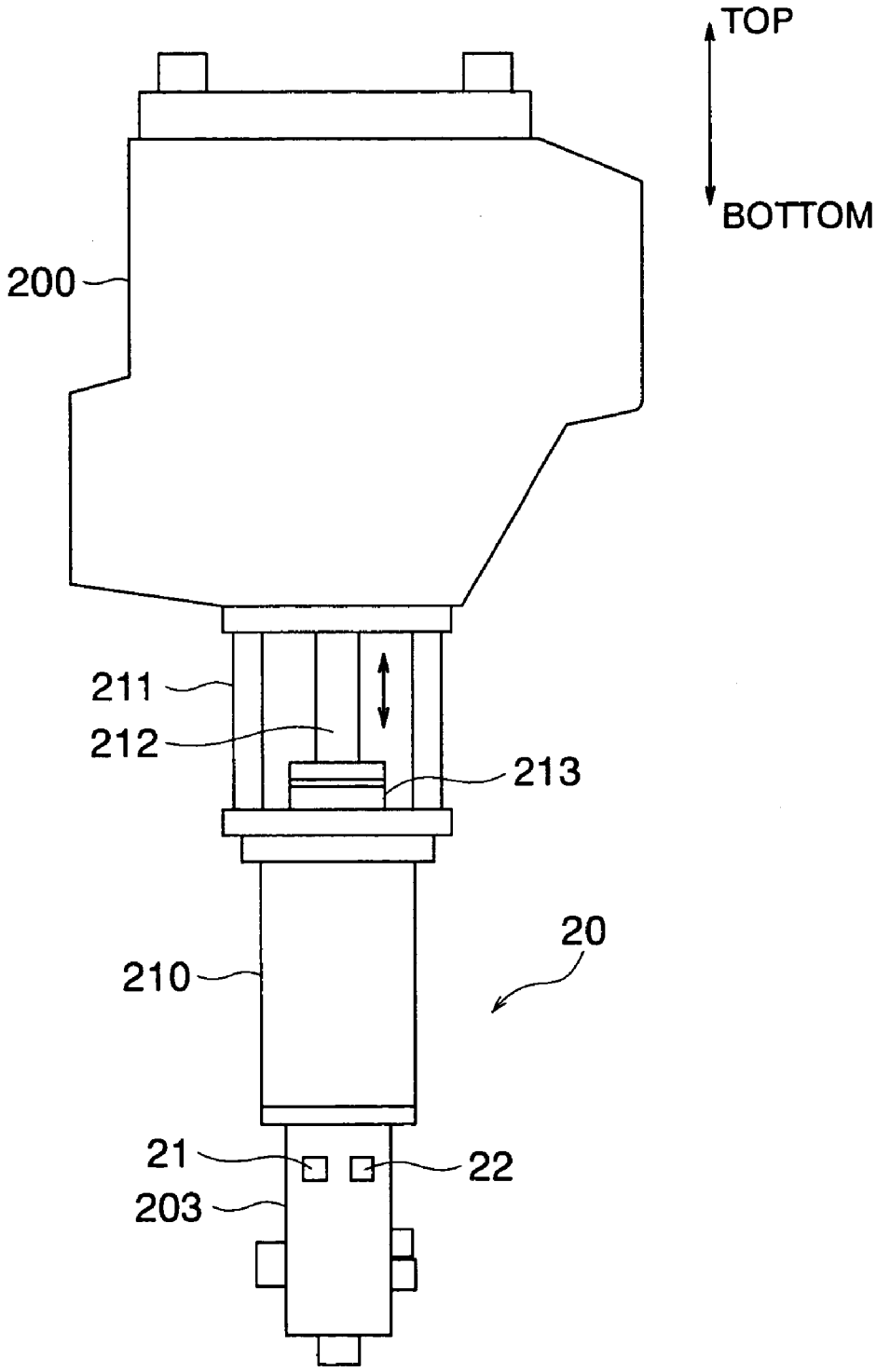
FIG. 3 is a view showing the schematic structure of an appearance of the steam valve and the drive unit for the steam valve.

FIG. 3 shows the schematic structure of an appearance of the steam valve 200, and on a lower side of the steam valve 200, a cylinder (oil cylinder) 203 accommodating the drive piston 202 (not shown in FIG. 3) therein is provided. The quick acting solenoid valves 21, 23 and so on of the above-described drive unit 20 are integrally provided on an outside portion of the cylinder 203. On an upper portion of the cylinder 203, an oil cylinder spring housing 210 is provided, and they constitute the drive unit 20. In the drive unit 20 shown in FIG. 3, the oil cylinder spring housing 210 is placed via a connection piece 211 on the lower side of the steam valve 200, and a valve rod 212 of the steam valve 200 is coupled to a coupling 213 formed to project on a top end portion of the oil cylinder spring housing 210. The height of the steam valve 200 is approximately three meters for example, and the diameter thereof is approximately two meters for example.

In this embodiment, an abnormal increase in the rotation speed of the steam turbine is mechanically detected by the emergency governor 1 and the emergency trip device 2, and a detecting signal thereof is converted into an electrical signal by the limit switch 6 and transmitted to the drive unit 20 for the steam valve 200 without an intervention of a transmitting means using oil pressure signals. Therefore, the equipment structure can be simplified as compared to conventional arts, no secondary mismatch such as oil leakage occurs, and reduction in response time and multiplication of the abnormality detecting device and abnormality detecting signal are easy, so that the reliability can be improved. Further, the emergency governor 1 and the emergency trip device 2 which conventionally exist can be used to compose the protection system, so that a drastic change in equipment is not needed.

Figure 4:
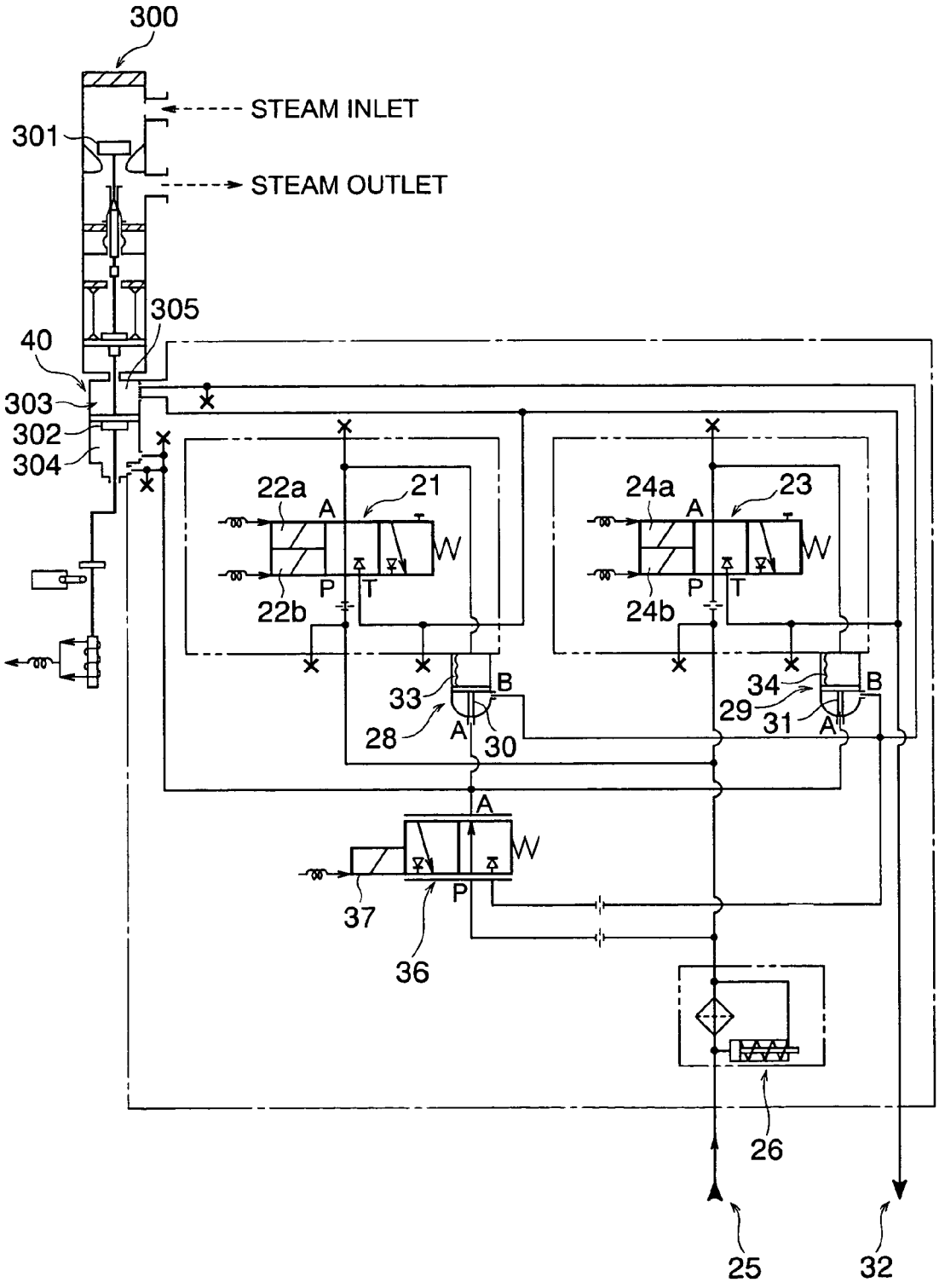
FIG. 4 is a view showing the configuration of a modification example of the drive unit for the steam valve shown in FIG. 2.

The drive unit 20 in the steam valve 200 shown in FIG. 2 is one including the servovalve 27 and having the valve position control function. However, depending on usage of the steam valve, there is one having a simple on/off function. A drive unit 40 for a steam valve 300 with this on/off function is shown in FIG. 4. Incidentally, the same reference numeral are designated to parts having the same functions as those in FIG. 2, and overlapping descriptions thereof are omitted.

The drive unit shown in FIG. 4 is one in which the servovalve 27 shown in FIG. 2 is replaced with a test solenoid valve 36, and is operated in a constantly non-excited state. The test solenoid valve 36 is excited at the time of valve testing, which is carried out for the purpose of preventing a valve rod accreting phenomenon of the steam valve 300 during normal operation, and operates so as to close a main valve 301 of the steam valve 300 by gradually discharging the oil inside a lower cylinder 304 of a drive piston 302. After the main valve 301 of the steam valve 300 fully closes, the main valve 300 gradually opens again by turning the test solenoid valve 36 into a non-excited state, and thus the valve test is completed. Further, when the test solenoid valve 36 is turned to the non-excited state at the time when the main valve 301 closes to a medium opening degree during the valve test, the main valve 301 operates so as to fully open thereafter. In other words, depending on an excitation method for the test solenoid valve 36, a half closing test or a full closing test of the main valve 301 can be selected.

The drive unit 40 for the steam valve 300 with the on/off function operates as such, but the operation related to the quick acting solenoid valves 21, 23 is the same as that in the case where the above-described servovalve 27 shown in FIG. 2 is provided.

Figure 5:
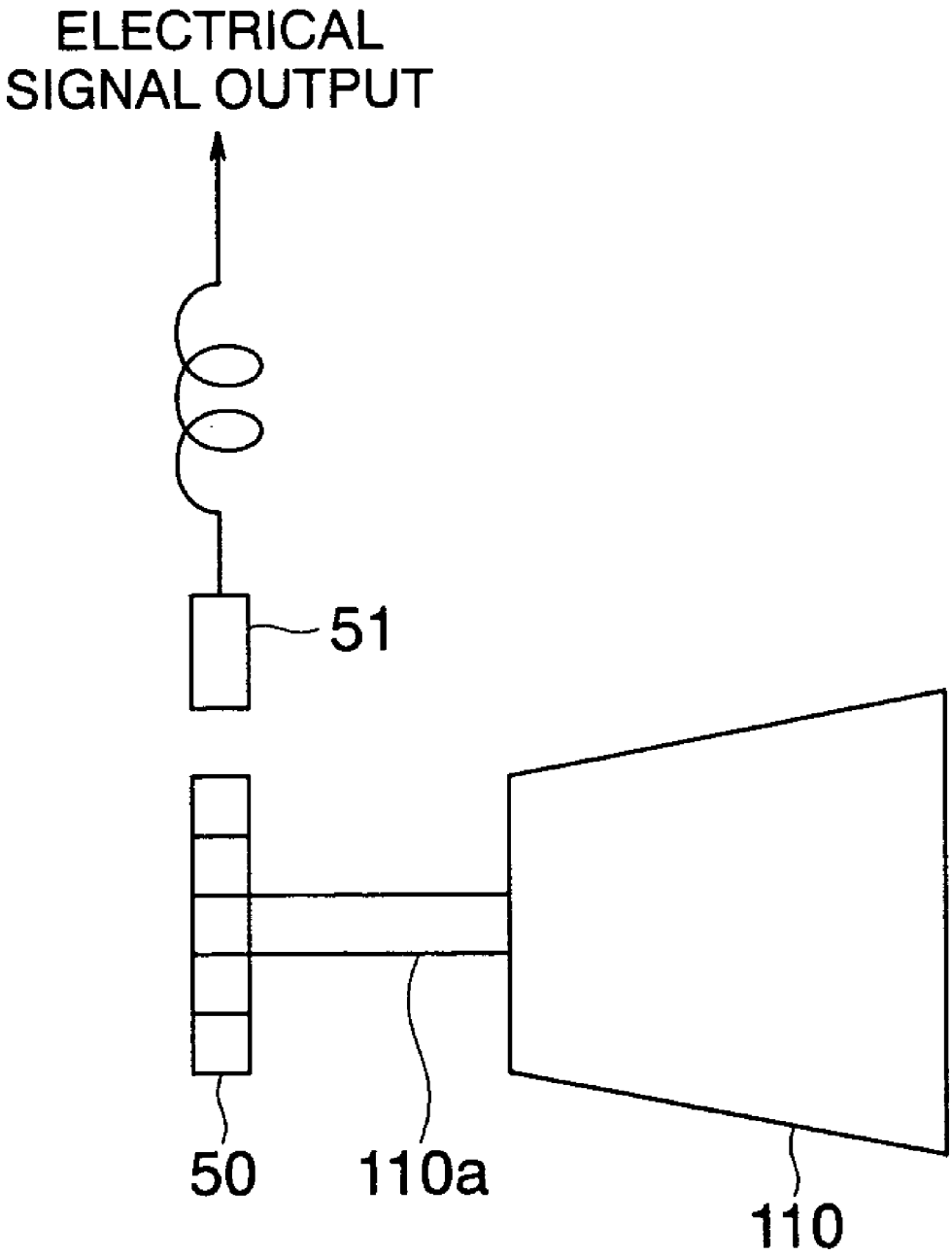
FIG. 5 is a view showing the configuration of an abnormality detecting unit according to another embodiment of the present invention.

Next, another embodiment will be described with reference to FIG. 5. In the embodiment shown in FIG. 1, when the rotation speed of the steam turbine rises to a set rotation speed or above, a mechanical deviation is detected and converted into an electrical signal. On the other hand, this embodiment directly detects the rotation speed of the steam turbine and converts it into an electrical signal.

On a rotation shaft 110*a* of a steam turbine 110, a gear 50 having a gear tooth number of approximately 100 is attached. Opposing this gear 50, an electromagnetic pickup 51 is assembled to form a combination with the gear 50 with a slight gap of approximately a few mm. According to the rotation speed of the turbine, a sinusoidal frequency output is obtained from the electromagnetic pickup 51, and this output is transmitted to a not-shown comparison calculation control device.

In the comparison calculation control device, the frequency is converted into a voltage or a digital count number and compared and calculated with a predetermined set rotation speed equivalent value, by which the rotation speed of the steam turbine is judged as an abnormal state. Then, when it is equal to the set rotation speed equivalent value or larger, a signal from the comparison calculation control device is applied to the quick acting solenoid valves 21, 23 placed in the drive unit 20 for the steam valve 200 shown in FIG. 2 or to the quick acting solenoid valves 21, 23 placed in the drive unit 40 for the steam valve 300 shown in FIG. 4 so that they turn into a non-excited state at the time of abnormality. Accordingly, the steam valve 200 and the steam valve 300 are closed.

Incidentally, at least one electromagnetic pickup 51 fulfills the purpose, but a plurality of the electromagnetic pickups 51, such as three, may be placed for the purpose of improving reliability. Further, by providing a group of plural electromagnetic pickups and plural comparison calculation control devices to be combined with the group, reliability of output signals from the comparison calculation control device can be improved.

In the above-described embodiment, the case of detecting an abnormal increase in the rotation speed of the steam turbine is described. However, in the steam turbine, when a phenomenon other than the abnormal increase in the turbine rotation speed such as an elongation difference of a steam turbine, large vibration, high temperature in a low pressure exhaust room, low oil pressure of bearing, low discharge pressure of a main oil pump, boiler/generator failure, and the like occurs, steam flow into the steam turbine must be shut off to prevent an accident from occurring or to minimize the damage due to an accident.

The system may also be configured such that an electrical signal from the abnormality detecting device which detects these abnormalities passes through the sequence circuit device or the comparison calculation control device depending on the specification of the detected electrical signal, and thereafter being applied to the quick acting solenoid valves 21, 23 to close the steam valve 200 and the steam valve 300 without an intervention of a transmitting means using oil pressure signals.

In the embodiment of the present invention as described above, since the detecting signal of detecting an abnormal state of the turbo machine is transmitted as an electrical signal without an intervention of a transmitting means using oil pressure signals, the equipment structure can be simplified as compared to conventional arts, no secondary mismatch such as oil leakage occurs, and reduction in response time and multiplication of the abnormality detecting device and abnormality detecting signal are easy, so that the reliability can be improved.

Figure 12:
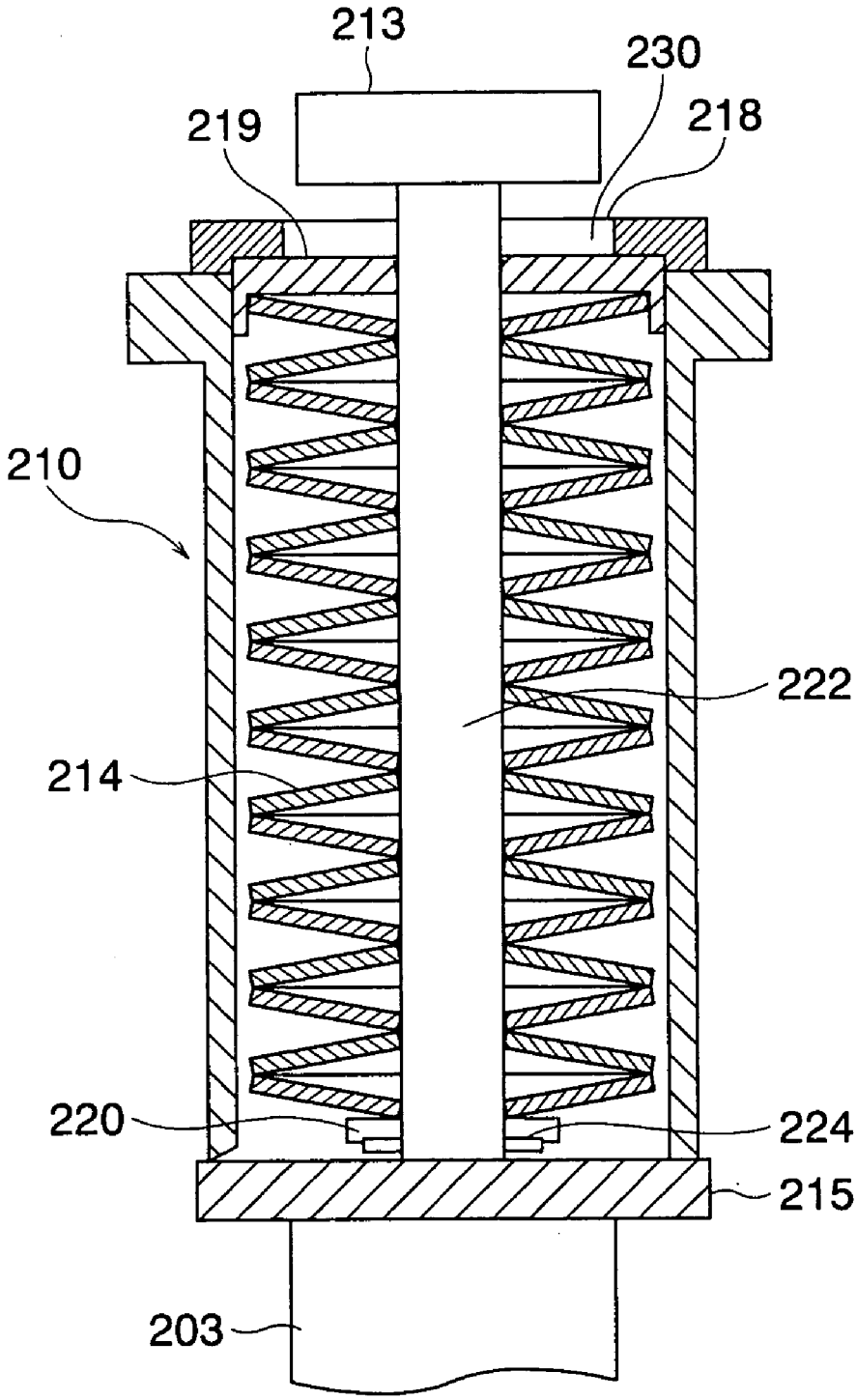
FIG. 12 is a view showing the structure of a substantial part of a conventional drive unit for a steam valve.

Meanwhile, the drive unit 20 which drives the steam valve 200 is constructed as shown in above-described FIG. 3. Regarding this drive unit 20, an adequate mechanical reliability is required. The inside of the oil cylinder spring housing 210 of the drive unit 20 is constructed to have, as shown in FIG. 12, a disk-shaped operating spring 214, an operation rod 222 placed to penetrate the disc-shaped operating spring 214, a top plate 219, and a spring bearing 220 as main parts.

The spring bearing 220 is placed for the purpose of supporting a lower end portion of the operating spring 214, and under the spring bearing 220, a support ring 224 fixed to the operation rod 222 is placed. On the other hand, the top plate 219 is disposed inside an upper end portion of the oil cylinder spring housing 210 so as to support the upper end portion of the operating spring 214, and fixed on the oil cylinder spring housing 210 by an upper flange body 218. The top plate 219 slidably supports, with a bottom plate 215 located at the lower end of the oil cylinder spring housing 210, the operation rod 222 via an operation rod through hole.

When the operation rod 222 is to be pushed up in a direction to open the valve, an oil pressure in the direction to open the valve is sent to the piston (not shown in FIG. 12) inside the cylinder 203, and a hydraulic force thereof pushes up the operation rod 222. On the other hand, when the operation rod 222 is to be pushed down in a direction to close the valve, an oil pressure is flown into a drain side, and a restoring force of the operating spring 214, which is contracted when the valve is closed, pushes down the operation rod 222.

The oil cylinder spring housing 210 constructed as such is designed without considering entrance of water inside, so that when water once enters, it keeps staying inside due to the structure, which may cause deterioration/damage of the operating spring 214.

As causes of the entrance of water inside the oil cylinder spring housing 210, there are two conceivable causes as follows. A first conceivable cause is that, when the drive unit 20 having a structure in which the oil cylinder spring housing 210 and the cylinder 203 are placed on the lower side of the steam valve 200 as shown in FIG. 3 is placed outdoor, or under a condition that the drive unit 20 is transported, stored, installed, inspected, and the like, the rain water stays in a recessed portion 230 formed by the upper flange body 218 and the top plate 219. A second conceivable cause is that a drain due to an ejection of steam from a sliding portion of the valve rod 212 while the turbine is operating stays in the recessed portion 230.

When water stays in the recessed portion 230 formed between the upper flange body 218 and the top plate 219 by such causes, the water gradually enters inside through a gap (namely, a sliding portion) between the through hole of the operation rod provided on the top plate 219 and the operation rod 222, and comes in contact with the operating spring 214.

The material of the operating spring 214 formed into a disc-shaped spring is made of high-tensile steel having high strength, in which a brittle fracture occurs due to a hydrogen embrittlement when being exposed to water for long time. The hydrogen embrittlement is an operation such that an iron oxide is formed by chemical reaction with water, and hydrogen separates out and enters a grain boundary to cause embrittlement. In the disc-shaped spring, a brittle crack occurs at a start point on an inner back surface where a tensile stress is high, which may results in destruction. If the operating spring 214 is damaged, the restoring force of the operating spring 214 does not work adequately, which can cause operation failure of the steam valve 200. Further, for example, it is possible that the steam valve 200 cannot be closed at the time of abnormality.

Therefore, taking a countermeasure for not exposing the inside of the oil cylinder spring housing 210 in a wet environment for a long period is an important object for not corroding/damaging the operating spring. Accordingly, a drive unit for a steam valve in which such problems are solved will be described below.

Figure 7:
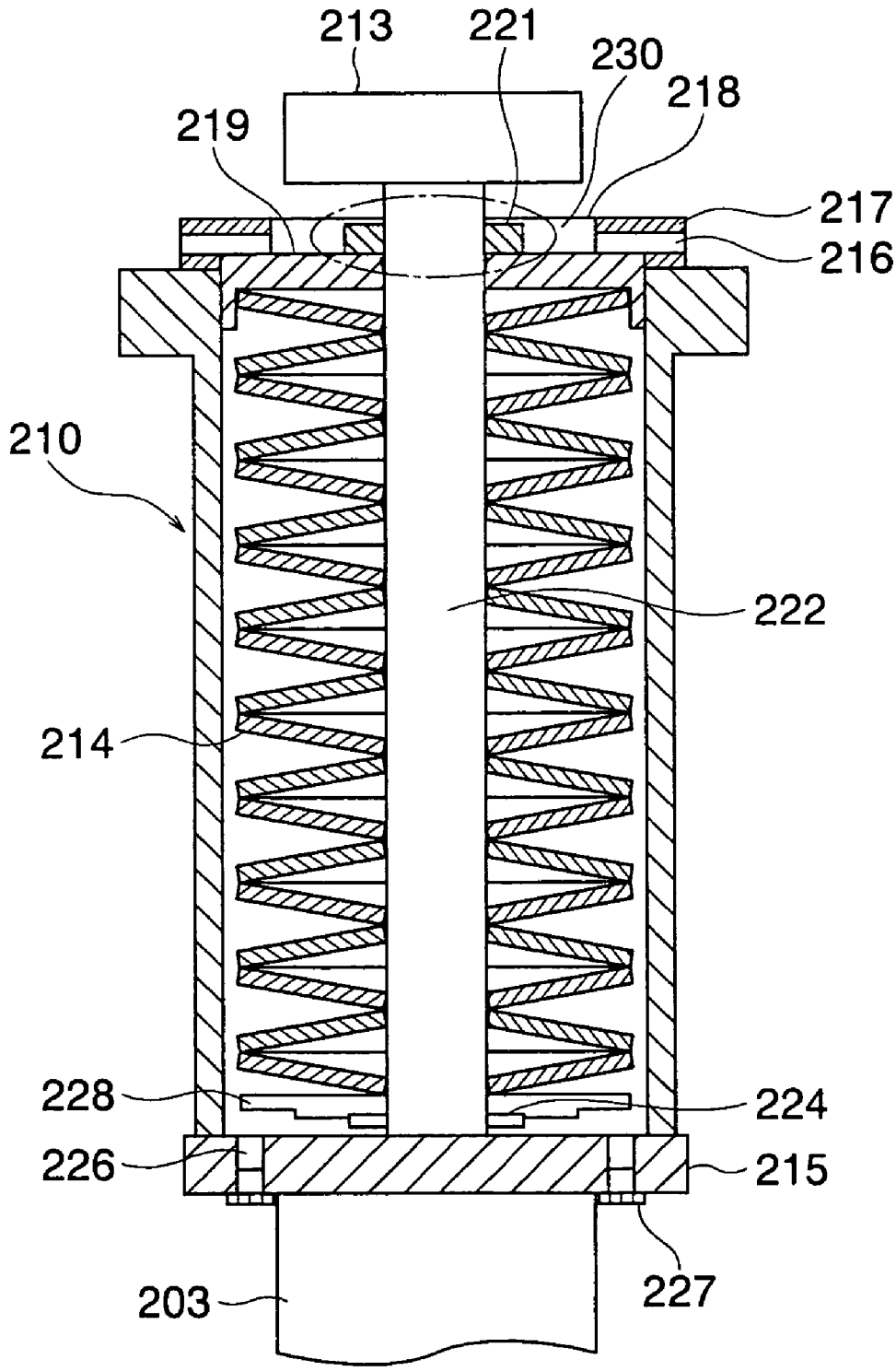
FIG. 7 is a view showing the structure of a substantial part of the drive unit for the steam valve according to the embodiment of the present invention.

In the cylinder spring housing 210 shown in FIG. 7, there are taken a first countermeasure to restrain entrance of water inside, a second countermeasure to drain water staying inside, and further a third countermeasure to prevent hindrance to opening/closing operation of the valve by corrosion/damage of the operating spring if they happen.

To begin with, the first countermeasure will be described. This countermeasure is to prevent water from staying in the recessed portion 230 formed between the upper flange body 218 and the top plate 219 located at the upper end portion of the oil cylinder spring housing 210. A drain hole 216 in a radial pattern to mutually connect the recessed portion 230 and an outer peripheral portion is formed on the flange portion 217 of the upper flange body 218, and further a raised portion 221 is formed so as to surround an operation rod through portion at the center portion of the top plate 219.

By thus forming the drain hole 216 on the flange portion 217 of the upper flange body 218, even when rain water or a drain due to an ejection or the like of steam from the sliding portion of the valve rod 212 of the steam valve 200 enters the recessed portion 230, it does not stay in the recessed portion 230 and flows out through the drain hole 216. Further, by forming the raised portion 221 so as to surround the operation rod through portion at the center portion of the top plate 219, flowing in of water from the through portion of the operation rod 222 can be restrained.

Next, the second countermeasure will be described. This countermeasure is to form one or more drain holes 226 facing downward on a bottom plate 215 at the lowest position in the case where the oil cylinder spring housing 210 is arranged in a vertical position. If the drain hole 226 cannot be formed on the bottom surface of the bottom plate 215, a drain hole (not shown) facing sideward is formed on a side surface of the bottom plate 215 or at a portion near the bottom plate 215 on a lower side surface of the oil cylinder spring housing 210. In either case, the size of the drain hole 226 is preferred to be at least a size that allows water to fall freely to be discharged, which is approximately 5 mm or larger in diameter for example.

On the drain hole 226, a filter 227 is attached for preventing a foreign object that can affect sliding of the operation rod 222 from entering inside the oil cylinder spring housing 210. The mesh size of the filter 227 is, for example, approximately 100 meshes. Incidentally, regarding the hole facing sideward and not facing downward among the drain holes 226, a shutoff plug may be attached so that an operator removes this shutoff plug appropriately to drain. This shutoff plug is described in FIG. 8.

According to this second countermeasure, the water entering inside the oil cylinder spring housing 210 flows down due to the operation of gravity and is discharged outside the oil cylinder spring housing 210 through the drain hole 226.

Furthermore, the third countermeasure will be described. As can be seen from a comparison of FIG. 7 with FIG. 12, this countermeasure is to have a spring bearing 228 adopted in this example with a diameter as large as approximately the inside diameter of the oil cylinder spring housing 210.

Thus, by setting the size of the spring bearing 228 to be as large as approximately the inside diameter of the oil cylinder spring housing 210, if the disc-shaped spring 214 at the lower portion which can be easily exposed to a wet environment is corroded/damaged, the spring bearing 228 can receive a relatively large fragment of the spring, which is approximately a few centimeters.

Consequently, fragments of the spring can be prevented from falling to the lower portion of the oil cylinder spring housing 210, so that hindrance to valve operation due to jamming of a damaged disc-shaped spring between the lower portion of the oil cylinder spring housing 210 and the spring bearing 228 can be avoided. Incidentally, damage to a few discs does not impair the function as a spring, so that the disc-shaped spring is still operative.

Figure 8:
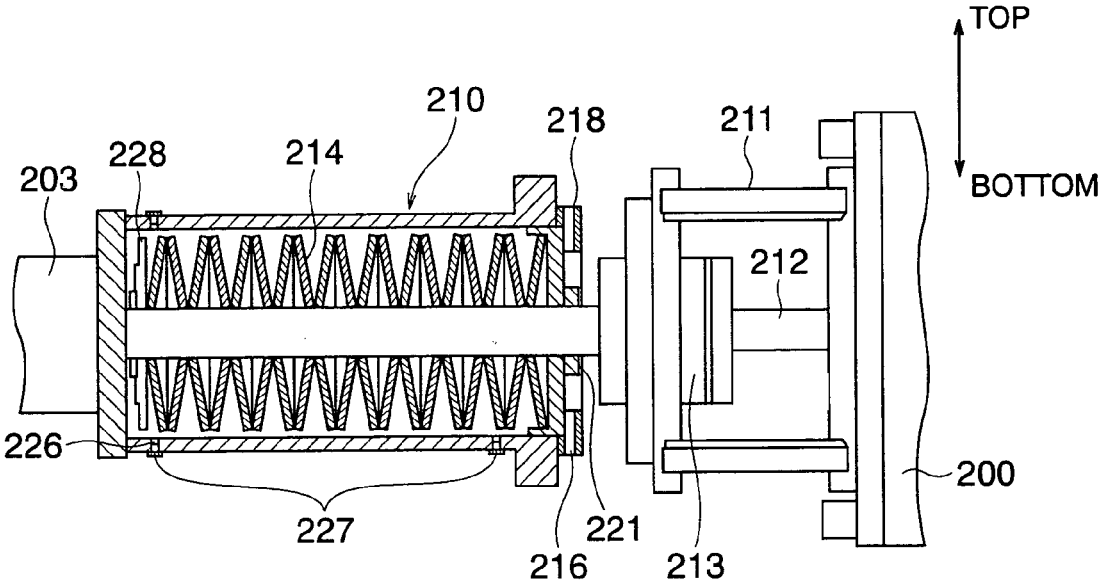
FIG. 8 is a view showing the structure of a substantial part of a drive unit for a steam valve according to another embodiment.

Next, another oil cylinder spring housing will be described with reference to FIG. 8. The difference between FIG. 8 and FIG. 7 is that the oil cylinder spring housing 210 and the cylinder 203 are placed in order vertically via a connection piece 211 on the lower side of the steam valve 200 in FIG. 7, whereas they are placed horizontally in FIG. 8. In FIG. 8, the first and second countermeasures are taken similarly as in FIG. 7. Incidentally, as described above, in the embodiment shown in FIG. 2 and so on, the equipment structure can be simplified and the entire equipment can be made compact, so that both the horizontal and vertical arrangements as shown in FIG. 8 can be freely adopted.

The first countermeasure has no difference from FIG. 7 because the drain hole 216 and the raised portion 221 are formed on the flange body 218 and the top plate 219. In the second countermeasure, since the oil cylinder spring housing 210 is placed horizontally, the positions of forming the drain holes are slightly different. Specifically, as shown in FIG. 8, two drain holes 226 are formed in a long side direction on positions, which oppose the ground, of the oil cylinder spring housing 210 placed horizontally.

The size of the drain holes 226 is, for example, approximately 5 mm or larger in diameter. On each drain hole 226, a filter 227 having approximately 100 meshes for example is attached. Incidentally, when a drain hole that does not face downward is formed, that is, for example, when the drain hole is positioned on an upper portion due to the convenience when attaching the oil cylinder spring housing 210, a shutoff plug 228 is attached.

In this case, water entering inside the oil cylinder spring housing 210 flows down due to the operation of gravity and is discharged outside the oil cylinder spring housing 210 through the drain hole 226. Accordingly, the operating spring 214 inside the oil cylinder spring housing 210 will not be exposed to a wet environment for a long period, which is effective to prevent corrosion/damage of the operating spring 214.

By attaching the filter 227, the drain hole 226 has an effect not to suck in a foreign object from outside through the drain hole 226 due to the expansion/contraction of the operating spring 214 accompanying the valve operation. Also with such a structure, the operating spring 214 inside the oil cylinder spring housing 210 will not be exposed to a wet environment for a long period, so that corrosion/damage of the operating spring 214 can be prevented.

Figure 9:
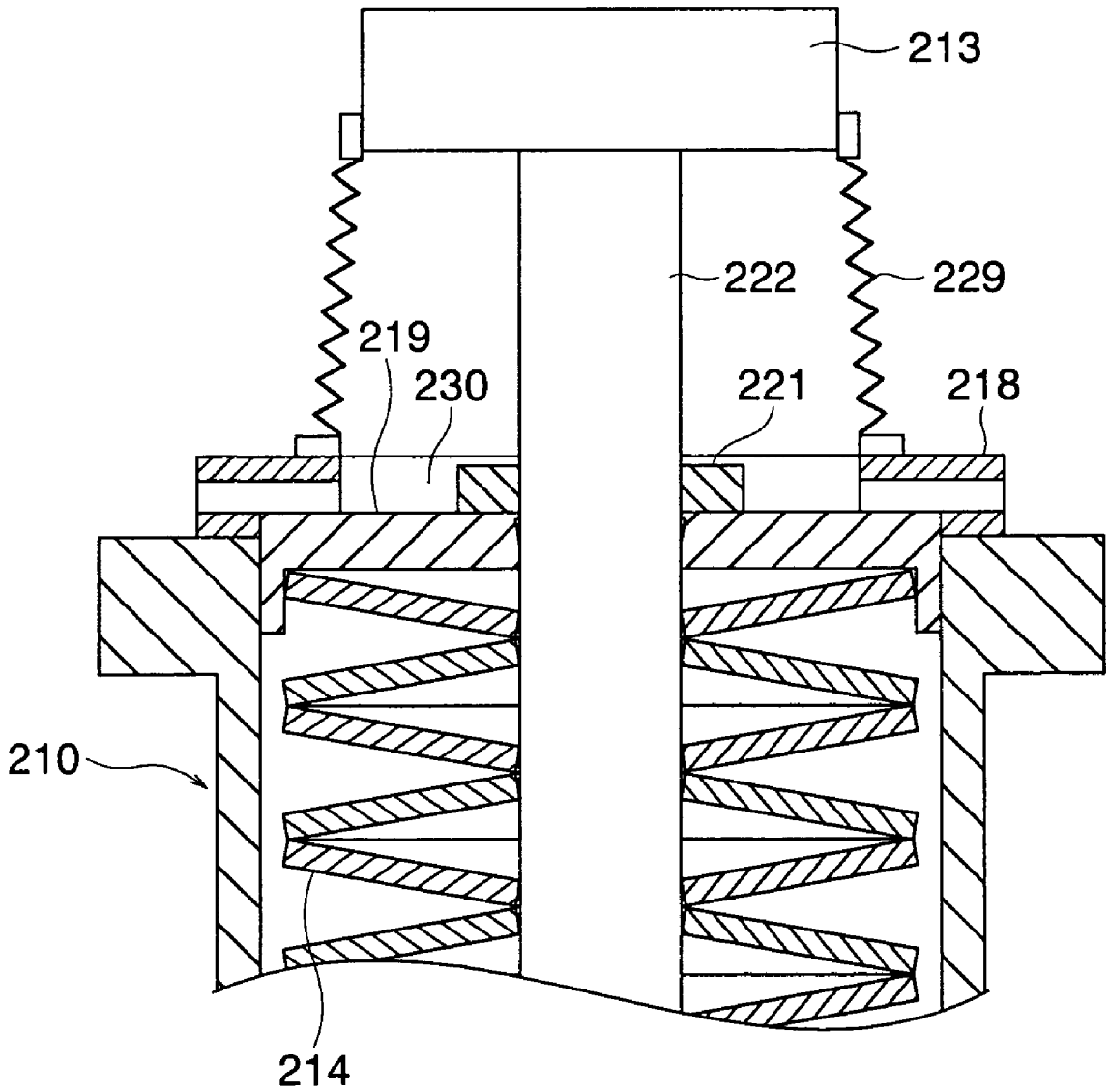
FIG. 9 is a view showing the structure of a substantial part of a drive unit for a steam valve according to another embodiment.

Next, with reference to FIG. 9, another oil cylinder spring housing will be described. FIG. 9 is a vertical cross-sectional view showing the vicinity of a flange body of the oil cylinder spring housing. FIG. 9 shows an improvement on the first countermeasure, in which one end of an elastic cover 229 such as bellows is fixed to a coupling 213 so as to cover the through portion of the operation rod 222 of the top plate 219, and the other end thereof is fixed to the upper flange body 218. The other structure has no particular difference from that in FIG. 7.

Thus, a space between the coupling 213 and the upper flange body 218 is covered by the elastic cover 229, so that when a plant is placed outdoor or during an operation, transportation, or inspection, a foreign object and water from outside can be prevented from staying in the recessed portion 230 of the top plate 219, and a drain due to an ejection of steam from a sliding portion of the valve rod while the turbine is operating can be prevented from staying in the recessed portion 230.

Figure 10:
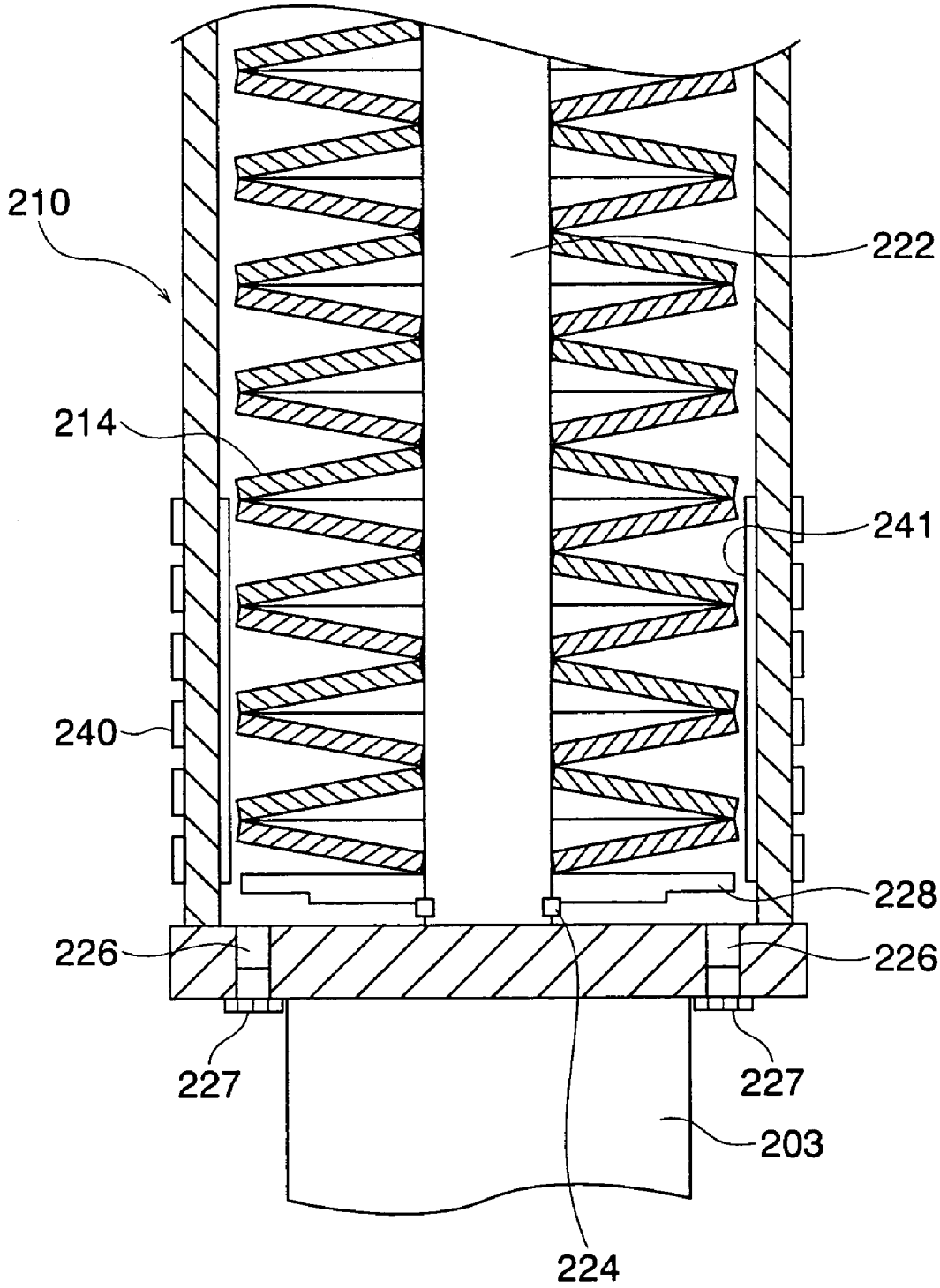
FIG. 10 is a view showing the structure of a substantial part of a drive unit for a steam valve according to another embodiment.
Figure 11:
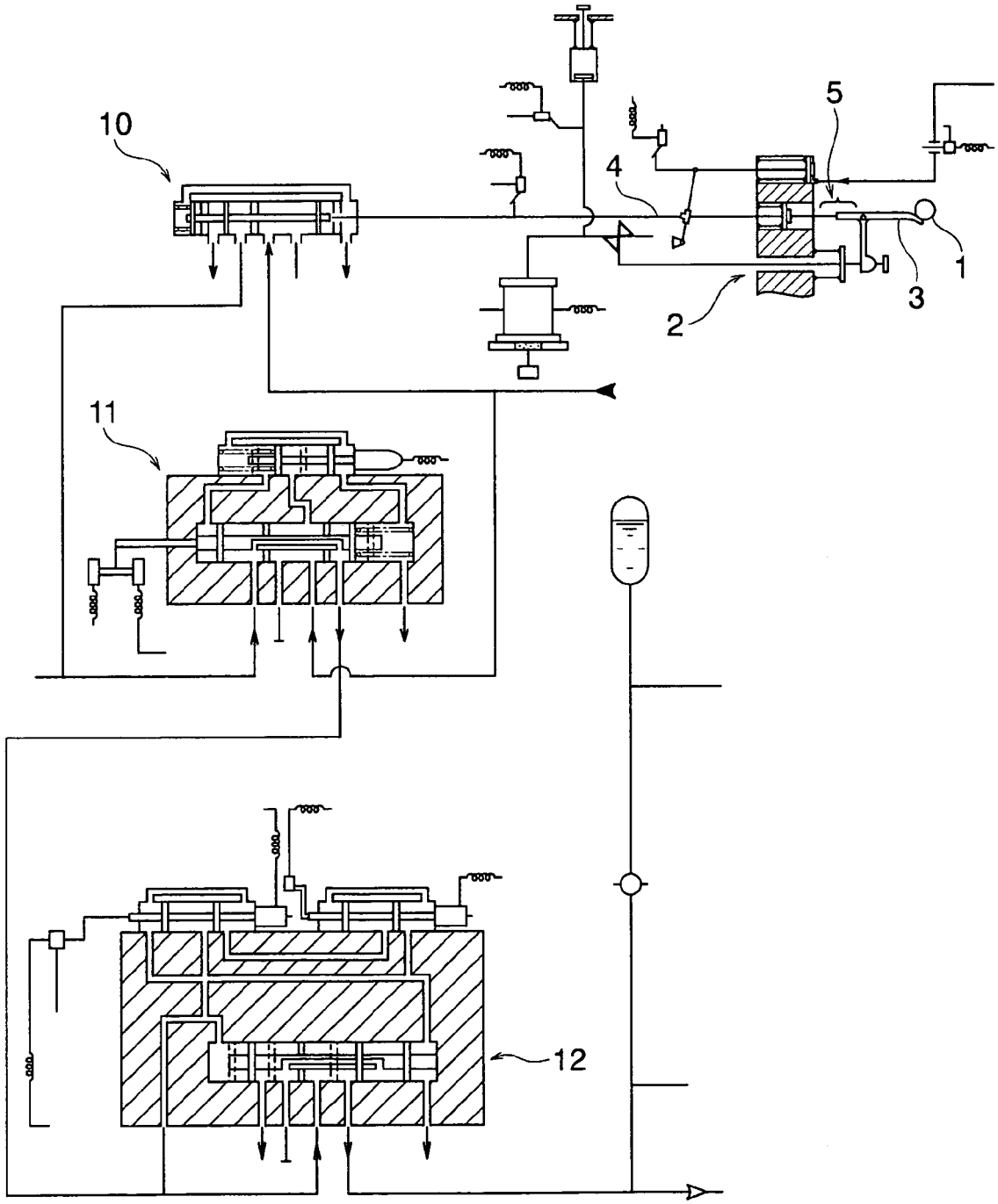
FIG. 11 is a view showing the structure of a conventional protection system for a turbo machine.

Next, with reference to FIG. 10, another oil cylinder spring housing will be described. FIG. 10 is a vertical cross-sectional view showing a lower portion of the oil cylinder spring housing. In FIG. 10, a waterproofed outer surface heater 240 in a band shape is wound on the outer surface of the lower portion of the oil cylinder spring housing 210, and a waterproofed inner surface heater 241 in a sheet form is wound on an inner surface of the lower portion of the oil cylinder spring housing 210, so that the valve main body and the valve drive unit can operate without being frozen even when placed in an environment where the low temperature is 0° C. or lower.

Thus, with the outer surface heater 240 or the inner surface heater 241 being placed on the oil cylinder spring housing 210, even when water enters inside the oil cylinder spring housing 210 used in a cold region, the water can be prevented from being frozen inside. Accordingly, the operation rod 222 can operate to push up or push down correctly according to instructions from the cylinder 203, so that operation of the steam valve 200 will not be hindered. Further, when water enters the oil cylinder spring housing 210 neither in a cold region nor in a low temperature state, the heater can still be activated to increase the temperature inside the oil cylinder spring housing 210 so that the water evaporates before corrosion of the disc-shaped spring proceeds and is discharged through the drain hole 226, and thus the inside can always be kept dry.

Incidentally, by making the filter 227 attached on the drain hole 226 from metal or applying a water sensitive agent on the filter 227, a function to identify whether or not there is contact of the filter 227 with water inside the oil cylinder spring housing 210 can be provided.

Using such a filter 227, when water enters inside the oil cylinder spring housing 210 and is discharged to the outside through the filter 227 attached to the drain hole 226, the contact with water can be recognized by rust or change in color of the surface of the filter 227.

Accordingly, when entrance of water cannot be recognized directly during an inspection, it becomes possible to recognize whether or not water entered inside the oil cylinder spring housing 210 in the past. When rust or change in color occurs on the surface of the filter 227, an inspection inside the oil cylinder spring housing 210 and of condition of the operating spring 214 can be carried out to prevent damage to the operating spring 214 by corrosion from occurring. Further, the filter 227 or the shutoff plug 228 attached to the drain hole 226 can also be removed to perform an inspection inside the oil cylinder spring housing 210.

Further, rust proof paint can be applied on the operating spring 214 so that the operating spring 214 does not rust easily if water enters inside the oil cylinder spring housing 210 and comes in contact with the operating spring 214.

Furthermore, rust proof paint and rust proof materials can also be used inside the oil cylinder spring housing 210 and for other components, water resistance inside the oil cylinder spring housing 210 can be enhanced. Incidentally, in the foregoing, the case where the operating spring 214 is constituted of a disc-shaped spring has been described, but the disc-shaped spring may be replaced with other springs such as a coil spring.

What is claimed is:

1. A drive unit for a steam valve, in which a valve rod of the steam valve and a piston inside a cylinder are coupled together via an oil cylinder spring housing internally having an operation rod and an operating spring, and in which at the time to open the valve, the operation rod accommodated in the oil cylinder spring housing is moved by the piston inside the cylinder to a valve opening position against a restoring force of the operating spring, and at the time to close the valve, the operation rod is returned to a valve closing position by the restoring force of the operating spring, comprising:

a drain hole which is formed on a lower portion of the oil cylinder spring housing and discharges water staying inside; and a filter attached to the drain hole, wherein the filter comprises a function to identify whether or not there is a contact with water.

2. The drive unit for the steam valve as set forth in claim 1, further comprising:

a shutoff plug attached on the drain hole which is formed on the oil cylinder spring housing and does not face downward.

3. The drive unit for the steam valve as set forth in claim 1, further comprising:

a drain hole placed on a flange body which is attached on an end portion on the steam valve side of the oil cylinder spring housing and supports the operation rod by penetration.

4. The drive unit for the steam valves set forth in claim 3, further comprising:

a raised portion formed on a periphery of a through portion of the operation rod on the flange body side.

5. The drive unit for the steam valve as set forth in claim 3, further comprising:

a coupling formed on one end of the operation rod and coupled to the valve rod; and an elastic cover whose one end is fixed to the coupling and other end is fixed to the flange body and covering a through portion of the operation rod.

6. The drive unit for the steam valve as set forth in claim 1, wherein rust proof paint is applied on the operating spring.

7. The drive unit for the steam valve as set forth in claim 1, wherein a disc-shaped spring is used as the operating spring, whose spring bearing has an outside diameter that is at least approximately the same as an inside diameter of the oil cylinder spring housing to prevent a damaged spring from falling to a lower portion of the oil cylinder spring housing.

8. The drive unit for the steam valve as set forth in claim 1, wherein a heater is placed on at least one of an inside portion and outer surface of the oil cylinder spring housing and prevents freezing of water staying inside the oil cylinder spring housing.

* * * * *